United States Patent [19]

Tsuda

[11] 4,448,567

[45] May 15, 1984

[54] METHOD FOR INSTALLING LINES, PIPES OR CABLES UNDERGROUND

[75] Inventor: Yutaka Tsuda, Kurume, Japan

[73] Assignee: Pipe Master International Ltd., Hong Kong, Hong Kong

[21] Appl. No.: 309,968

[22] PCT Filed: Apr. 15, 1980

[86] PCT No.: PCT/JP80/00075

§ 371 Date: Oct. 1, 1981

§ 102(e) Date: Oct. 1, 1981

[87] PCT Pub. No.: WO81/02317

PCT Pub. Date: Aug. 20, 1981

[30] Foreign Application Priority Data

Feb. 5, 1980 [JP] Japan ..... 55-12804

[51] Int. Cl.[3] ..... E02B 13/00; E02D 29/10; E02F 5/10; E03F 3/06

[52] U.S. Cl. ..... 405/43; 405/156; 405/184

[58] Field of Search ..... 405/154, 156, 146, 184, 405/43, 176; 175/62, 171

[56] References Cited

U.S. PATENT DOCUMENTS

| | | | |
|---|---|---|---|
| 1,904,666 | 4/1933 | Sack | 405/156 |
| 3,217,501 | 11/1965 | Boa | 405/156 |
| 3,251,332 | 5/1966 | Vassar | 405/156 X |
| 3,540,223 | 11/1970 | Ebbe | 405/43 |
| 3,774,403 | 11/1973 | Cushing | 405/184 X |
| 3,996,758 | 12/1976 | Cherrington | 405/184 |
| 4,249,620 | 2/1981 | Schmidt | 405/184 X |
| 4,285,613 | 8/1981 | Takagishi et al. | 405/156 |

FOREIGN PATENT DOCUMENTS

| | | | |
|---|---|---|---|
| 1544340 | 9/1968 | France | 405/156 |

*Primary Examiner*—David H. Corbin
*Assistant Examiner*—Nancy J. Stodolo
*Attorney, Agent, or Firm*—Jordan and Hamburg

[57] ABSTRACT

This invention relates to a method for efficiently installing lines, pipes or cables underground. In operation, a boring head which forms an elongated bore underground along with the movement of a boring device is disposed underground. A flat plastic sheet is continuously reeled out and is formed into a rigid plastic tube. A hauling rope is simultaneously reeled out into the rigid plastic tube, such plastic tube and hauling rope have their front extremities connected to the rear end of the boring head. The plastic tube is continuously installed underground along with the movement of the boring head. The movement of the boring head also provides simultaneous extending of the hauling rope in and along a installed plastic tube. The front portion of the line, pipe or cable is connected to the tail portion of the extended hauling rope. Finally, only the hauling rope is pulled or hauled within and along the plastic tube so as to install the line, pipe or cable in and along the plastic tube.

2 Claims, 6 Drawing Figures

METHOD FOR INSTALLING LINES, PIPES OR CABLES UNDERGROUND

TECHNICAL FIELD

This invention relates to a method for installing lines, pipes or cables underground, which can be especially efficiently utilized in irrigation, water supplying, water conveyance and geothermal exchange.

BACKGROUND ART

For example, in conventional irrigation or irrigating operations, the watering of the land is effected such that primarily a trench is dug in the ground, then the water supply pipes are installed in the trench and finally the trench is filled up with the soil or earth. As for the installation of cables (e.g. for supply of electricity, for telecommunication) a propulsion method is used. However, such conventional methods have not achieved satisfying results heretofore. For example, the methods involve hard labor of the workers and have suffered an extremely poor efficiency.

Accordingly, it is an object of the present invention to provide a method which can easily and readily install lines, pipes or cables underground irrespective of the purpose and the size thereof.

DISCLOSURE OF INVENTION

Namely, this invention relates to a method for efficiently installing lines, pipes or cables underground. In operation, a boring head 1 which forms an elongated bore underground along with the movement of a boring device 2 is disposed underground. A flat plastic sheet 4 is continuously reeled out and is formed into a rigid plastic tube 5 by a tube forming device. A hauling rope 7 is simultaneously reeled out into the rigid plastic tube 5. Such plastic tube 5 and a hauling rope 7 have their front extremities connected to the rear end of the boring head 1. Subsequently plastic tube 5 is continuously installed underground along with the movement of the boring head 1. Such movement of the boring head 1 also provides for the simultaneous extending of the hauling rope 7 in and along the installed plastic tube 5. The front portion of a desired line, pipe or cable is connected to the tail portion of the extended hauling rope 7. Finally, only the hauling rope 7 is pulled or hauled within and along the stationary plastic tube 5 so as to install the line, pipe or cable in and along the plastic tube 5.

BEST MODE FOR CARRYING OUT THE INVENTION

The present invention is described in details hereinafter in conjunction with attached drawings.

Figure 1:
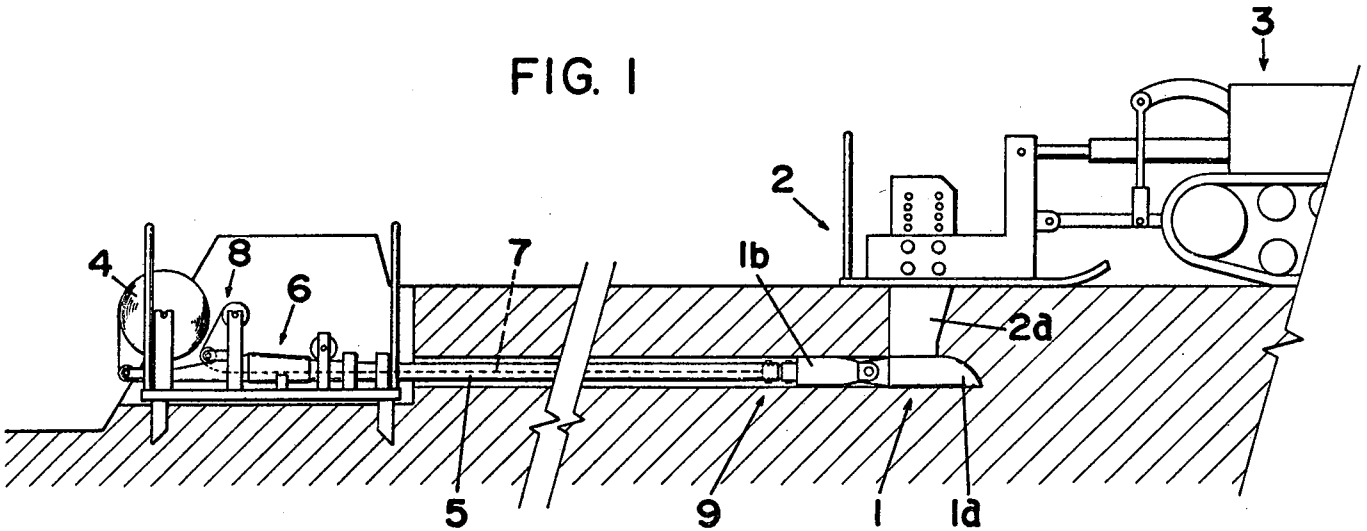
FIG. 1 is an entire explanatory view of the installing apparatus utilized in the method of this invention.
Figure 2:
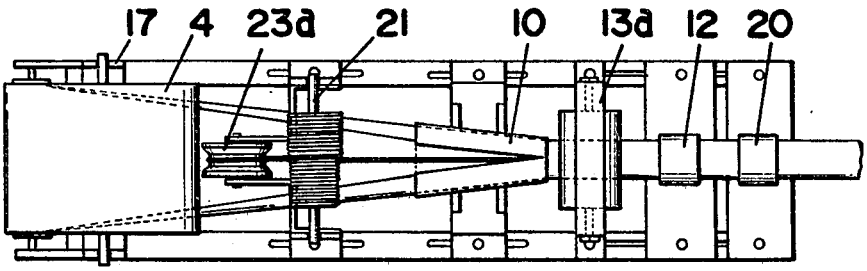
FIG. 2 is a plan view of the plastic-tube-forming device and of the rope supplying device.
Figure 3:
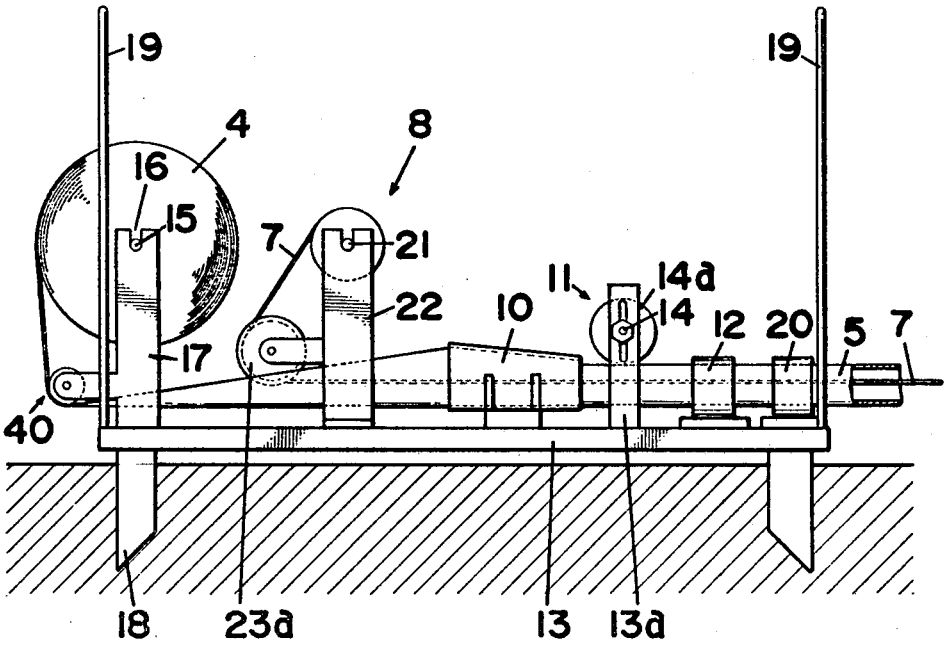
FIG. 3 is a front view of the above devices.

In FIG. 1 and FIG. 2, the entire construction of the installing apparatus used for the method of this invention is disclosed. The installing apparatus substantially comprises a boring device 2 which is provided with an elevatable boring head 1 and is moved in any direction on the ground for boring a horizontal hole underground, a hauling machine 3 such as a bulldozer for hauling the boring device 2, a plastic-tube-forming device 6 which forms continuously a plastic tube 5 from a flat plastic sheet 4 disposed behind the boring device 2, a rope supplying device 8 which continuously supplies a hauling rope 7 into the plastic tube 5 and a connecting means 9 which connects the front extremities of the plastic tube 5 and the hauling rope 7 to the rear end of the boring head 1.

Figure 4:
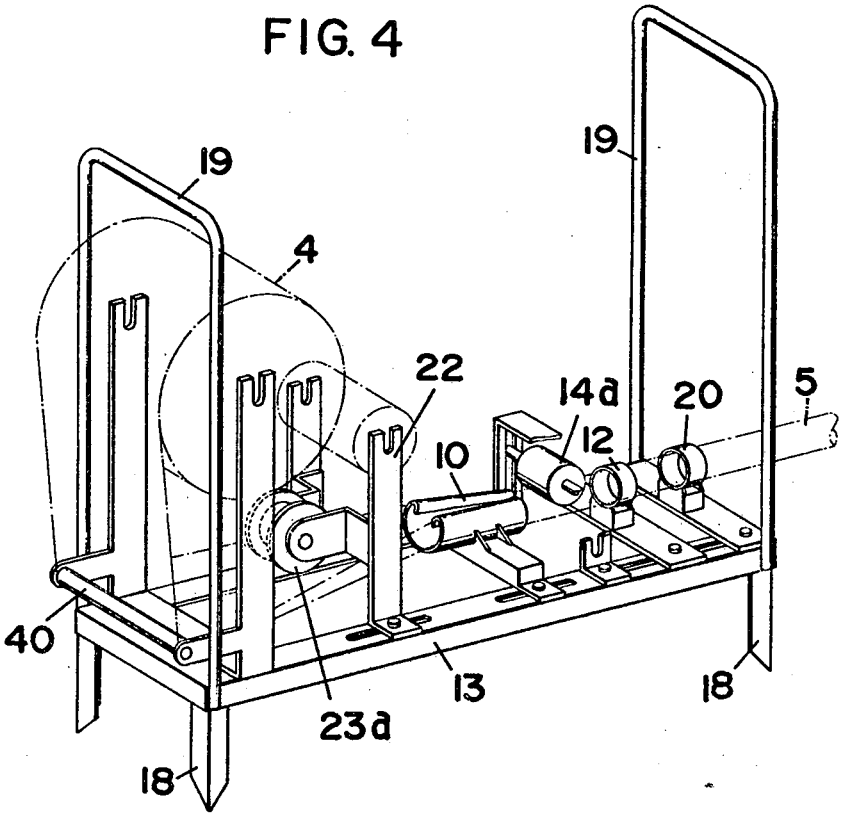
FIG. 4 is a perspective view of the same devices.

In FIG. 2 and FIG. 4, the construction of the plastic-tube-forming device 6 and of the rope supplying device 8 is shown in detail.

Referring to the plastic-tube-forming device, a spool of flat plastic sheet 4 is preferably supported on vertical support struts 17 by placing a support shaft 15 in a groove 16 formed on the struts 17, which in turn are mounted on a frame structure 13. This frame structure 13 is firmly mounted on the lower ground by driving a plurality of piles 18 into the ground.

In front of the support strut 17, a guide sleeve 10 which forms the flat plastic sheet 4 unreeled from the spool into the plastic tube 5 is disposed horizontally. Namely, since the guide sleeve 10 has a circular and tapered construction, the flat plastic sheet 4 unreeled from the spool is formed into the plastic tube 4 at the outlet of the guide sleeve 10. The guide sleeve 10 is fixedly secured to the frame structure 13.

Adjacent to the outlet of the tapered guide sleeve 10, a tube press means 11 is disposed. Such tube press means 11 comprises a press roller **14*a* which presses the abutting ends of the plastic tube 5. Numeral 13*a* indicates a support which rotatably supports the press roller 14*a* on the frame structure 13 by a supporting shaft 14**.

In alignment with the guide sleeve 10 and the press roller **14*a*, a tube-forming ring 12 is disposed in front of the press roller 14*a*. This ring 12 is provided for transforming the plastic tube 5** into a complete circular cross section.

For defining or restricting the drawn-out direction of the plastic tube 5, a beacon ring 20 may be provided subsequent to and adjacent to the tube-forming ring 12.

The support strut 2 is further provided with a tension roller 40 which facilitates the smooth unreeling of the flat plastic sheet 4 from the spool while the frame structure 3 carries a pair of grip bars 19 at the front and rear ends thereof. Upon engaging suspended hooks of a crane (not shown in the drawings) with such bars 19, the plastic-tube-forming device can be easily lifted from the lower land.

The rope supplying device 8, in this embodiment, is disposed between the support strut 17 and the guide sleeve 10. The device 8 is constructed such that a support shaft 21 on which the rope 7 is wound around is rotatably supported by a support strut 22, while a rope supply guide roller **23*a* which is provided for facilitating the supply of the lower end of the rope 7 into the plastic tube 5 is supported by the distal end of a support arm 23**.

Figure 5:
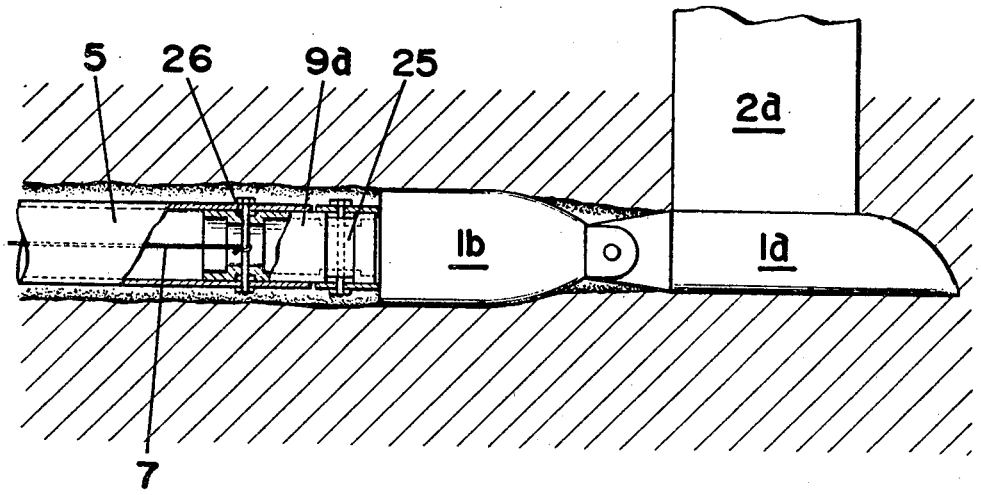
FIG. 5 is an enlarged explanatory view showing the connection of plastic tube and the hauling rope to the boring head.

In FIG. 5, the construction of the connecting means 9 is described in detail, wherein the connecting means 9 substantially comprises a cylindrical body **9*a*** which has the front end thereof connected with the rear end of a trail body 1*b* (the boring head 1 substantially consisting of a propelling head 1*a* connected to a cutting blade 2*a* and the trail body 1*b*) by means of a connecting pin 25 and the rear end thereof connected to the front extremity of the plastic tube 5 by means of a connecting pin 26. The front extremity of the hauling rope 7 is connected to the connecting pin 26.

The manner in which the installing apparatus of the above construction is operated for conducting the method of this invention is hereinafter disclosed.

Primarily a desired length of the hauling rope 7 is unrolled or pulled out from the rope winding reel and the front extremity of the hauling rope 7 is connected to the rear end of the trail body 1*b* of the boring head 1 utilizing the connecting pin 26. Subsequently the front end of the plastic sheet 4 is unreeled from the spool and is introduced into the guide sleeve 10 by way of the tension roller 40. The thus introduced plastic sheet 4 is then formed into a tubular shape along with its progress within the tapered circular guide sleeve 10 and is completely formed into the plastic tube 5 by passing through the press means 11, the tube-forming ring 12 and the beacon ring 20. The encasing of the hauling rope 7 within the plastic tube 5 is conducted simultaneously with the above tube-forming operation. The front extremity of the plastic tube 5 formed in the above manner is connected to the rear end of the trail body 1*b* of the boring head 1 in the same manner as that of the hauling rope 7 using the connecting pin 26. The hauling apparatus 3 such as a bulldozer is moved in a desired direction.

Since the boring head 1 is connected with the hauling machine 3, along with the progress of the hauling machine 3, the boring head 1 progresses steadily.

The cutting blade 2*a* facilitates the progress of the boring head 1 as described previously. As the boring head 1 is hauled, the plastic tube 5 which is connected to the boring head 1 is also hauled steadily. Simultaneously, due to the above hauling force, the flat plastic sheet 4 is continuously unreeled from the spool and subsequently is formed into the plastic tube 5 by means of the tube forming device 6.

Figure 6:
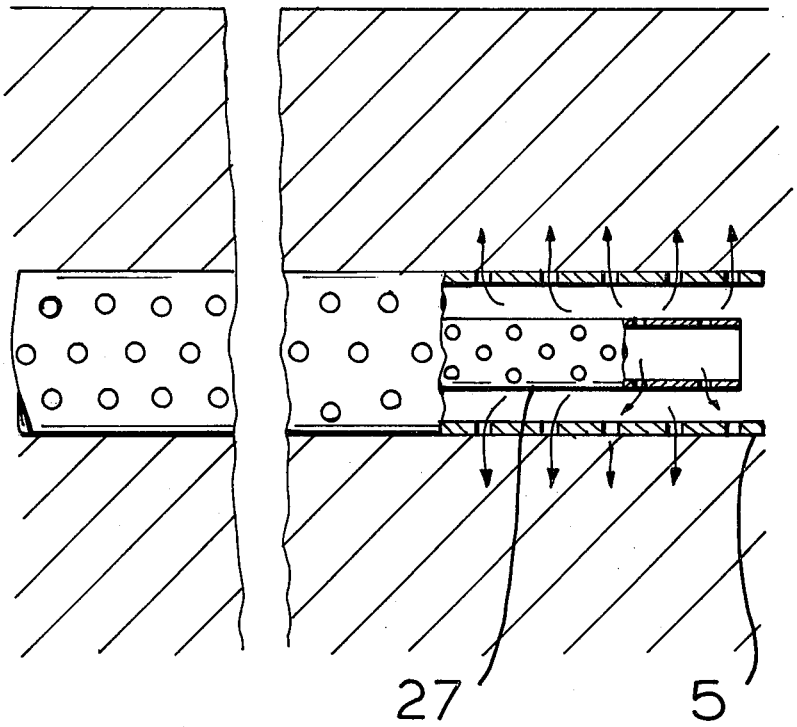
FIG. 6 is an explanatory view showing the installation of irrigation pipe utilizing the method of this invention.

Along with the above unreeling of the flat plastic sheet 4, the hauling rope 7 which is connected to the boring head 1 is also hauled in the plastic tube 5 at the same speed as the plastic tube 5, while the hauling rope 7 is continuously unreeled from the rope winding reel. When the plastic tube 5 is installed a predetermined length underground (this implies that the hauling rope 7 is also extended in and along the plastic tube 5 the same length), the installed plastic tube 5 has both ends thereof disconnected from the tube forming device 6 and the boring head 1 respectively. Then the hauling rope 7 has both ends thereof disconnected from the rope winding reel and the boring head 1 respectively. After disconnecting of the plastic tube 5 and the hauling rope 7, any desired line, pipe or cable is connected to the tail end of the now-disconnected hauling rope 7. Finally, only the hauling rope 7 is again hauled within and along the now-stationary plastic tube so as to install such line, pipe or cable in and along the plastic tube 5. Such hauling can be done manually or using hauling apparatus. FIG. 6 shows an embodiment where the method of this invention is utilized for irrigation. An inner irrigation tube 27 (the outer irrigation tube being provided by the plastic tube 5) has the front end thereof connected to the rear end of the hauling rope 7. Then the front end of the rope 7 is pulled continuously so as to install the inner irrigation tube 27 in the plastic tube 5. Due to such installation, when water is supplied into the inner irrigation tube 27, the water flows out through flow regulating apertures formed in the periphery of the inner irrigation tube 27 into the outer irrigation tube 5 and then infiltrates into the soil or the earth through apertures formed in the periphery of the outer irrigation tube 5.

The plastic sheet disclosed in Japanese Utility Model Application No. SHO51-41817 may be preferably used for the above irrigation purpose.

INDUSTRIAL APPLICABILITY

As has been described heretofore, the installation method of this invention has the following advantages.

(1) Lines, pipes, conduits, or cables for irrigation, water supply, water conveyance, geothermal exchange and various other applications can be readily, easily and inexpensively installed underground.

(2) Such lines, conduits or cables can vary in size and quantity at will.

What we claim is:

1. Method for efficiently installing various lines, pipes or cables underground comprising;
   - (i) disposing a boring means underground, said boring means being movable in a desired direction so as to form an elongated hole underground,
   - (ii) connecting a front end of a plastic tube formed from a flat plastic sheet to a rear end of said boring means,
   - (iii) connecting a front end of a hauling rope to said rear end of said boring means through said plastic tube,
   - (iv) propelling said boring means underground so as
     - (a) to form said elongated hole underground,
     - (b) to unreel said flat plastic sheet, to form said plastic tube from said flat plastic sheet while preventing said plastic tube from returning to to said original plastic flat sheet,
     - (c) to unreel said hauling rope within said plastic tube,
   - (v) installing said plastic tube and said hauling rope in and along said elongated hole along with said propelling of said boring means,
   - (vi) disconnecting said front end of said plastic tube and said front end of said hauling rope from said rear end of said boring means,
   - (vii) connecting a front end of a desired line, pipe or cable to a rear end of said installed hauling rope, and
   - (viii) pulling only said hauling rope in and along said plastic tube thus installing said line, pipe or cable in and along said plastic tube, whereby any kind of size of lines, pipe or cable having a diameter less than said plastic tube can be installed in said plastic tube by being hauled through said plastic tube by said hauling rope.

2. Method for efficiently installing and effecting irrigation utilizing an underground irrigation pipe system comprising;
   - (i) disposing a boring means underground, said boring means being movable in a desired direction so as to form an elongated hole underground,
   - (ii) connecting a front end of an outer plastic irrigation tube formed from a perforated flat plastic sheet to a rear end of said boring means, said plastic irrigation tube having a plurality of holes formed by the perforations in said perforated flat plastic sheet, (iii) connecting a front end of a hauling rope to said rear end of said boring means through said outer plastic irrigation tube, (iv) propelling said boring means underground so as
(a) to form said elongated hole underground,
(b) to unreel said perforated flat plastic sheet, to form said outer plastic irrigation tube from said perforated flat plastic sheet while preventing said outer plastic irrigation tube from returning to said original perforated plastic flat sheet,
(c) to unreel said hauling rope within said outer plastic irrigation tube, (v) installing said outer plastic irrigation tube and said hauling rope in and along said elongated hole along with said propelling of said boring means, (vi) disconnecting said front end of said outer plastic irrigation tube and said front end of said hauling rope from said rear end of said boring means, (vii) connecting a front end of an inner plastic irrigation tube to a rear end of said installed hauling rope, said inner plastic irrigation tube having a plurality of holes, (viii) pulling only said hauling rope in and along said outer plastic irrigation tube, thus installing said inner plastic irrigation tube in and along said outer plastic irrigation tube, and (ix) supplying water to said inner plastic irrigation tube, flowing said water through said plurality of holes in said inner plastic irrigation tube into said outer plastic irrigation tube, and flowing said water through said plurality of holes in said outer plastic irrigation tube to infiltrate into the surrounding earth to effect irrigation thereof.

* * * * *